US007277061B2

(12) United States Patent
Fusco et al.

(10) Patent No.: US 7,277,061 B2
(45) Date of Patent: Oct. 2, 2007

(54) SINGLE APERTURE MONOPULSE ANTENNA

(75) Inventors: Vincent Francis Fusco, Belfast (GB); Bandaru Subbarao, Chennai (IN)

(73) Assignee: The Queens University of Belfast, Belfast (IE)

( * ) Notice: Subject to any disclaimer, the term of this patent is extended or adjusted under 35 U.S.C. 154(b) by 9 days.

(21) Appl. No.: 11/071,423

(22) Filed: Mar. 3, 2005

(65) Prior Publication Data

US 2005/0200548 A1 Sep. 15, 2005

(30) Foreign Application Priority Data

Mar. 6, 2004 (GB) ..... 0405112.4

(51) Int. Cl.
*H01Q 13/00* (2006.01)
*H01Q 19/00* (2006.01)

(52) U.S. Cl. ..... 343/778; 343/772; 343/786; 343/756

(58) Field of Classification Search ..... 343/786, 343/772, 776, 778, 756
See application file for complete search history.

(56) References Cited

U.S. PATENT DOCUMENTS

| | | | | |
|---|---|---|---|---|
| 3,560,976 A | | 2/1971 | Foldes | 343/100 |
| 3,569,870 A | * | 3/1971 | Foldes | 333/21 R |
| 3,699,583 A | * | 10/1972 | Beguin | 343/756 |
| 4,096,482 A | * | 6/1978 | Walters | 343/778 |
| 4,473,828 A | | 9/1984 | Mörz et al. | 343/786 |
| 6,281,855 B1 | * | 8/2001 | Aoki | 343/786 |

FOREIGN PATENT DOCUMENTS

| | | |
|---|---|---|
| JP | 06029721 | 1/1999 |

* cited by examiner

*Primary Examiner*—Hoang V. Nguyen
(74) *Attorney, Agent, or Firm*—Drinker Biddle & Reath LLP

(57) ABSTRACT

An antenna comprises a polarizer, a phasing network and a field radiating element such as a horn. The polarizer and phasing network generate a plurality of phase shifted circularly polarised waves which are superimposed to produce multiple antenna field patterns from a single antenna aperture.

17 Claims, 10 Drawing Sheets

Figure 5A:
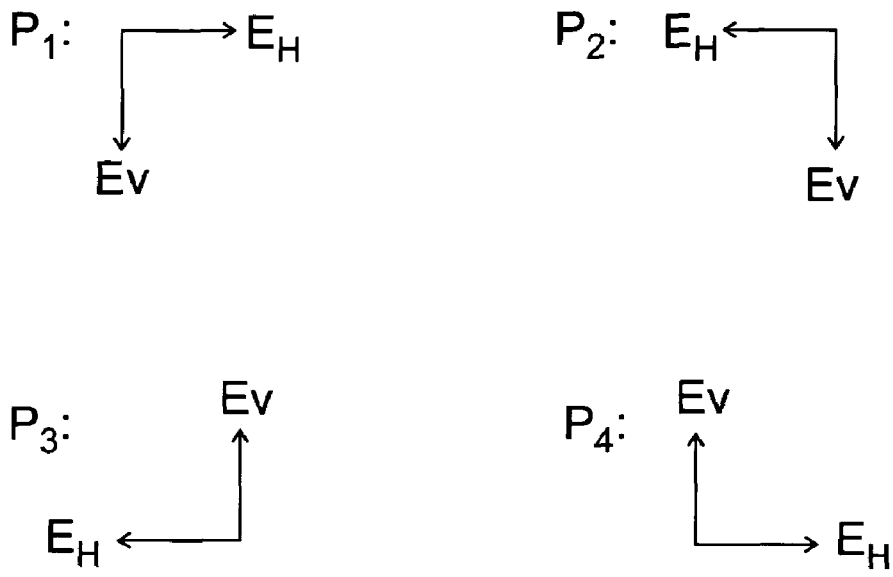

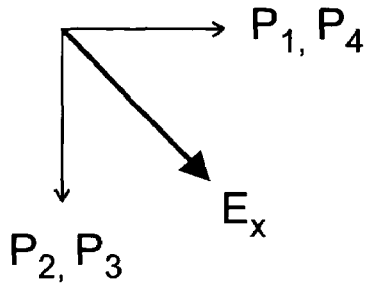
Fig. 5(d).1
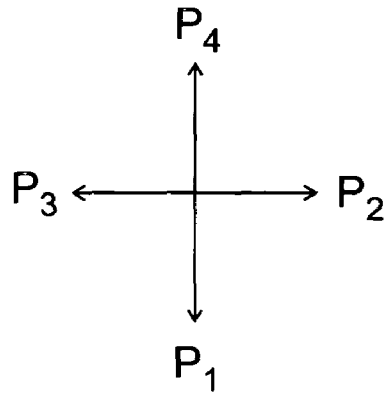
Fig. 5(d).2
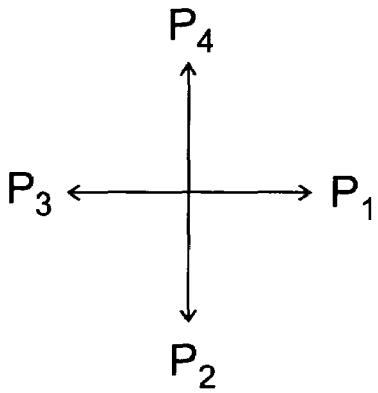
Fig. 5(e).1
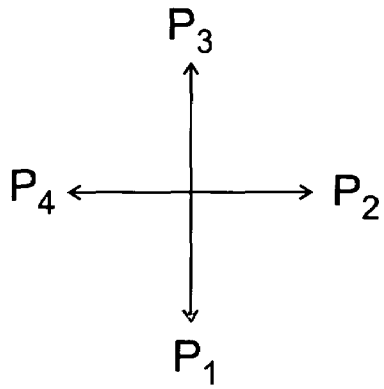
Fig. 5(e).2

SINGLE APERTURE MONOPULSE ANTENNA

The present invention relates to an antenna and in particular a single aperture monopulse antenna.

BACKGROUND OF THE INVENTION

Monopulse radar tracking systems have traditionally relied on complex antenna and phasing structures to produce and receive radar signals. In contrast, the present invention provides a simple antenna structure that takes advantage of the propagation and superposition properties of circularly polarized (CP) waves.

Accordingly, before describing the invention in more detail, it will be useful at this point to briefly review monopulse radar tracking systems and the generation and superposition properties of CP waves.

Figure 1:
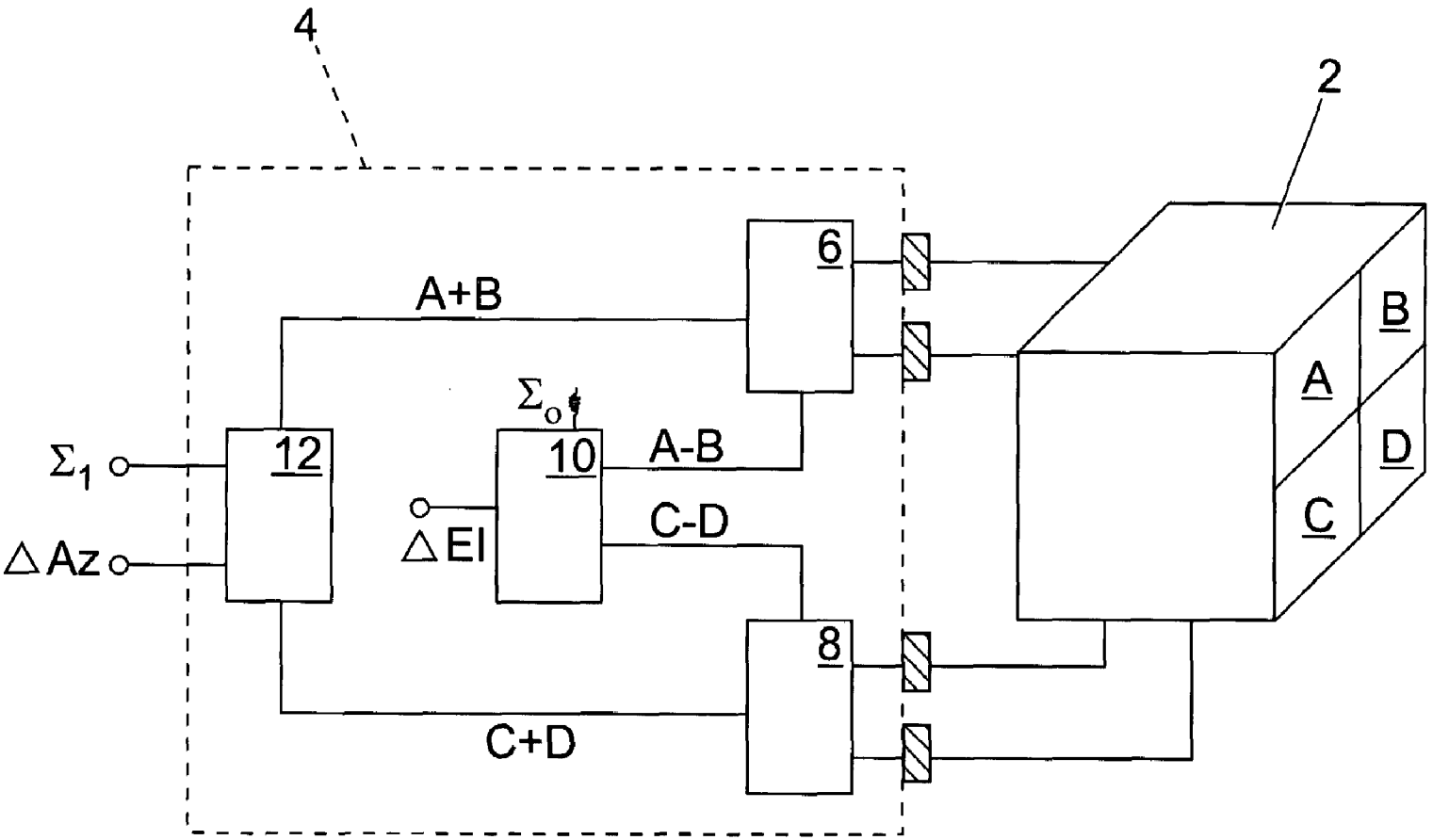
Figure 2A:
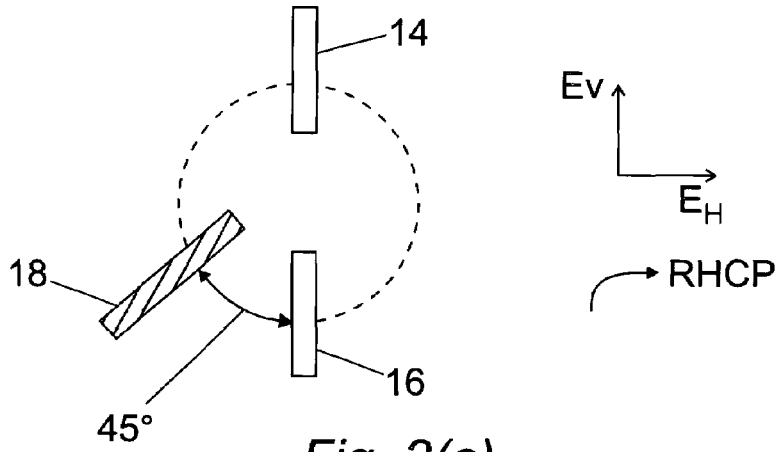
Figure 2B:
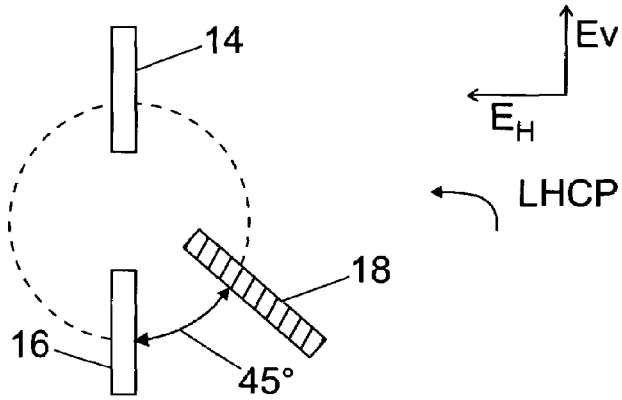
Figure 2C:
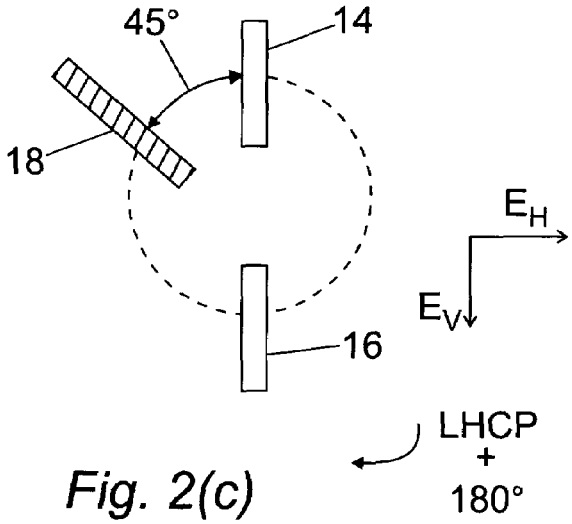
Figure 2D:
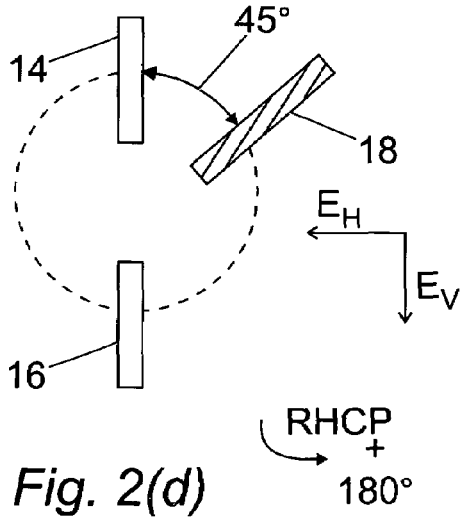

The brief overview of the monopulse radar tracking system and the generation and superposition properties of CP waves is described with reference to the accompanying Figures in which:

FIG. 1 which is a block diagram of a traditional monopulse radar tracking system apparatus; and FIGS. 2(*a*), 2(*b*), 2(*c*) and 2(*d*) are diagrammatic representations of a metal post-probe apparatus for generating CP waves, wherein for ease of interpretation, FIGS. 2(*a*), 2(*b*), 2(*c*) and 2(*d*) additionally show the orientation of the electric field vectors generated in the apparatus and the rotational directions of the resulting CP waves.

(a) Monopulse Radar Tracking Systems

The purpose of a tracking system is to determine the location or direction of a target on a near-continuous basis. This data can then be used by a fire control system, to ascertain the target's motion and predict its future position.

One of the most accurate electronic scanning techniques for the purpose of target tracking is the monopulse (simultaneous) lobing technique. In the monopulse radar tracking technique, the range, bearing and elevation-angle of a target can be determined from a single pulse. FIG. 1 shows a simplified block diagram of a traditional four horn monopulse radar tracking system apparatus. Each pulse comprises four signals of equal amplitude. The four signals are radiated at the same time from four horns A, B, C and D that are grouped together in a cluster 2.

The monopulse radar tracking system is designed so that the signal from each horn can be distinguished from those of the other horns, for example, by using different polarizations for each horn's signal. A comparator circuit 4 continuously compares the amplitude (or phase) of the return echo signals received by each horn with those received in the other horns. The comparator circuit 4 comprises waveguides and four hybrid junctions called "magic tees" (6, 8, 10 and 12 in FIG. 1). Each junction receives two input signals and produces two output signals representing the sum and difference between the two input signals respectively. Accordingly junction 6 produces outputs (A+B) and (A−B) and junction 8 produces outputs (C+D) and (C−D). Similarly, junction 10 produces outputs $\Sigma_o$ ((A+C)−(B+D)) and ΔEl ((A+D)−(B+C)) and junction 12 produces outputs $\Sigma_1$ (A+B+C+D) and ΔAz ((A+B)−(C+D)).

In order to determine whether a target is present and determine its range, the beams from all four horns are summed (i.e. to generate the sum signal $\Sigma_1$). The resulting beam has a single lobe. Consequently, the radar will receive a large return signal from a target centered within the beam.

If a target is detected, the return signals from the four horns are combined by junctions 6, 8, 10 and 12, to produce broadside difference patterns. These difference patterns are characterised by the presence of a broad peak and a sharp null. The ΔAz output from junction 12 is used to determine the azimuth of the target. The ΔEl output of junction 10 is used to determine the elevation of the target. If the target is located on the boresight axis, the amplitude of the target's return signal will be equalized in all four horns (i.e. the target will be located in the null region). The radar system's tracking circuit and power drives use this principle to track the motion of a target by moving the horn cluster 2 in the direction which equalises the amplitude of the return signal in all four horns A, B, C and D.

Notwithstanding the accuracy advantages of the monopulse radar tracking technique over conventional mechanical scanning radar tracking techniques, the monopulse radar tracking system apparatus is typically bulky and expensive because it requires four independent (or partitioned) horns.

U.S. Pat. No. 6,281,855 describes a single radiating element antenna structure capable of producing monopulse summation and difference far field patterns. In effect, the antenna operates by electromagnetically creating conditions for four separate radiating apertures within a single physical aperture. More specifically, the antenna employs four individually fed dielectric rods inserted into the horn and symmetrically disposed along the horn's major axis. When excited, the dielectric rods cause the electric fields inside the horn to distort and become asymmetrical thereby producing the summation and difference far field patterns.

(b) Generation and Superposition Properties of Circularly Polarized (CP) Waves

General Properties of CP Waves

The polarization of an electromagnetic wave is defined by the shape and orientation of the tip of the E vector as it varies with time. Circular polarization is a polarization state where the perpendicular components of an electrical field are of equal magnitude and have a 90° phase difference, so that the tip of the electric field vector traces a circle on the plane that is perpendicular to the direction of wave propagation. When the tip of the electric field vector rotates in a clockwise direction, as viewed from the antenna, as time progresses a right-hand circularly polarized (RHCP) wave is generated. Similarly, when the tip of the electric field vector rotates in an anti-clockwise direction a left-hand circularly polarized (LHCP) wave is generated.

Whilst the electric field vector rotates in a circle in the plane perpendicular to the direction of wave propagation, along the propagation axis itself, the movement of the tip of the electric field vector describes a helix.

Generating CP Waves

A CP wave can be generated by passing a linearly polarized (LP) wave through a waveguide that contains an internal delay element positioned at 45° with respect to the LP wave. The components of the LP signal are thus decomposed into two orthogonal E vectors. Since the LP wave which passes through the delay element travels more slowly than through the waveguide, a phase difference is created between the portion of the wave which travels through the waveguide and the portion that travels through the delay element. If the waveguide and the delay element are of sufficient length a differential 90° phase shift can be induced between the two portions of the LP wave. Provided these are of equal magnitude then when these two portions of the LP wave are combined at the output of the waveguide, a circularly polarized signal is produced. The above delay-waveguide structure behaves like a low pass filter.

FIGS. 2(*a*), 2(*b*), 2(*c*) and 2(*d*) show an alternative apparatus for generating CP waves, wherein the apparatus behaves more like a high pass filter. Referring to FIG. 2(*a*), the apparatus comprises two metal posts 14 and 16 aligned at 180° to each other. Assuming that post 16 represents the 0° position, the apparatus further comprises a probe 18 positioned at 225°. If a voltage is applied to the probe 18, the resulting electric field resolves itself into two components, namely a vertical component $E_v$ which is directed along the post 16 and a horizontal component $E_H$ which is directed perpendicularly to the post 16. The vertical component $E_v$ must travel past the metal posts. However, since a field moves more slowly past the metal posts than through air, the vertical component $E_v$ experiences a phase shift compared to $E_H$. The metal posts are designed to ensure that this phase shift is 90°. Accordingly, in a manner akin to the above-mentioned waveguide-dielectric system, the wave produced from the output of the metal post-probe apparatus is circularly polarized. For the sake of clarity, the resulting wave is hereby defined to have a right-handed rotation (i.e. an RHCP wave)

FIGS. 2(*b*), 2(*c*) and 2(*d*) show a similar apparatus to that of FIG. 2(*a*). However, in the case of FIG. 2(*b*) the probe 18 is located at the 135° position (relative to post 14) and the resulting wave is an LHCP wave. In the case of FIG. 2(*c*) the probe 18 is located at the −45° position (relative to post 14) and the resulting wave is an LHCP wave with a 180° phase shift. Finally, in FIG. 2(*d*) the probe is located at the +45° position (relative to post 14) and the resulting wave is an RHCP wave with a 180° phase shift.

Superposition Properties of CP Waves

If an RHCP wave is combined with an LHCP wave, the result is an LP wave. Similarly, if an RHCP wave is combined with an LHCP wave with a 180° phase shift, the result is an LP wave with a 90° phase shift with respect to the case where no phase shifts are applied to either CP signal.

SUMMARY OF THE INVENTION

According to the invention there is provided a single aperture monopulse antenna that superimposes a plurality of phase shifted circularly polarized waves to produce multiple field patterns in a single antenna aperture.

Preferably, the single aperture monopulse antenna includes a metal post polarizer and a phasing network to generate the plurality of circularly polarized waves.

Preferably, the metal post polarizer comprises at least one probe and at least two posts, wherein the number of probes is substantially the same as the number of antenna apertures mimicked by the single aperture monopulse antenna.

Desirably, the metal post polarizer and the phasing network generate circularly polarized waves by applying a linear polarized wave to each of the at least one probes, to decompose the linearly polarized wave into orthogonal wave components at each of the at least one probes, and adding a phase shift to each of the orthogonal wave components at at least one of the at least one probes. Preferably, the circularly polarized waves are superimposed in the aperture of the single aperture monopulse antenna.

Preferably, the phasing network comprises a 3 dB Wilkinson power divider and at least two 90° branch line couplers.

Desirably, the single aperture horn antenna further comprises an axisymmetrical field radiating element.

Preferably, the axisymmetrical field radiating element is a Potter horn.

Preferably, the multiple aperture antenna field patterns are summation and difference patterns.

According to a second aspect of the invention there is provided a method of generating multiple field patterns from a single aperture antenna by the superposition of a plurality of phase shifted circularly polarized waves to create superimposed linearly polarized waves.

Preferably, the superimposed linearly polarized waves produce summation and difference field patterns.

Preferably, the summation field pattern is produced by the superposition of at least one right circularly polarized wave with an equal number of left circularly polarized waves.

Preferably, the difference field pattern is produced by the superposition of at least one right circularly polarized wave with at least one left circularly polarized wave wherein the at least one left circularly polarized wave is provided with an appropriate phase shift.

According to a third aspect of the invention there is provided a use of a single aperture monopulse antenna that superimposes phase shifted circularly polarized waves to produce multiple aperture antenna field patterns in a radar target tracking apparatus.

According to a fourth aspect of the invention there is provided a use of a single aperture horn antenna which superimposes phase shifted circularly polarized waves to produce multiple aperture antenna field patterns in a mobile satellite communications system.

According to a fifth aspect of the invention there is provided a use of a single aperture horn antenna which superimposes phase shifted circularly polarized waves to produce multiple aperture antenna field patterns in a vehicular anti-collision radar system.

ADVANTAGES OF THE INVENTION

The present invention provides a simple single aperture antenna suitable for monopulse sensor applications. In particular, the invention provides a simple feed network which when used in combination with the Potter horn antenna allows sum (pencil) and difference (conical) patterns to be generated.

Since the present invention employs a considerably simpler hardware structure than conventional monopulse radar systems, the antenna would be less expensive and considerably smaller and lighter than used in traditional monopulse radar systems. Furthermore, the present invention could be used in radar control, sensing or mobile satellite communications applications.

DESCRIPTION AND DRAWINGS

An embodiment of the invention operating in the I band (8 GHz to 10 GHz) will now be described by way of example only with reference to the accompanying figures in which:

FIG. 1 which is a block diagram of a traditional monopulse radar tracking system apparatus.

FIGS. 2(*a*), 2(*b*), 2(*c*) and 2(*d*) are diagrammatic representations of a metal post-probe apparatus for generating CP waves, wherein for ease of interpretation, FIGS. 2(*a*), 2(*b*), 2(*c*) and 2(*d*) additionally show the orientation of the electric field vectors generated in the apparatus and the rotational directions of the resulting CP waves.

Figure 3:
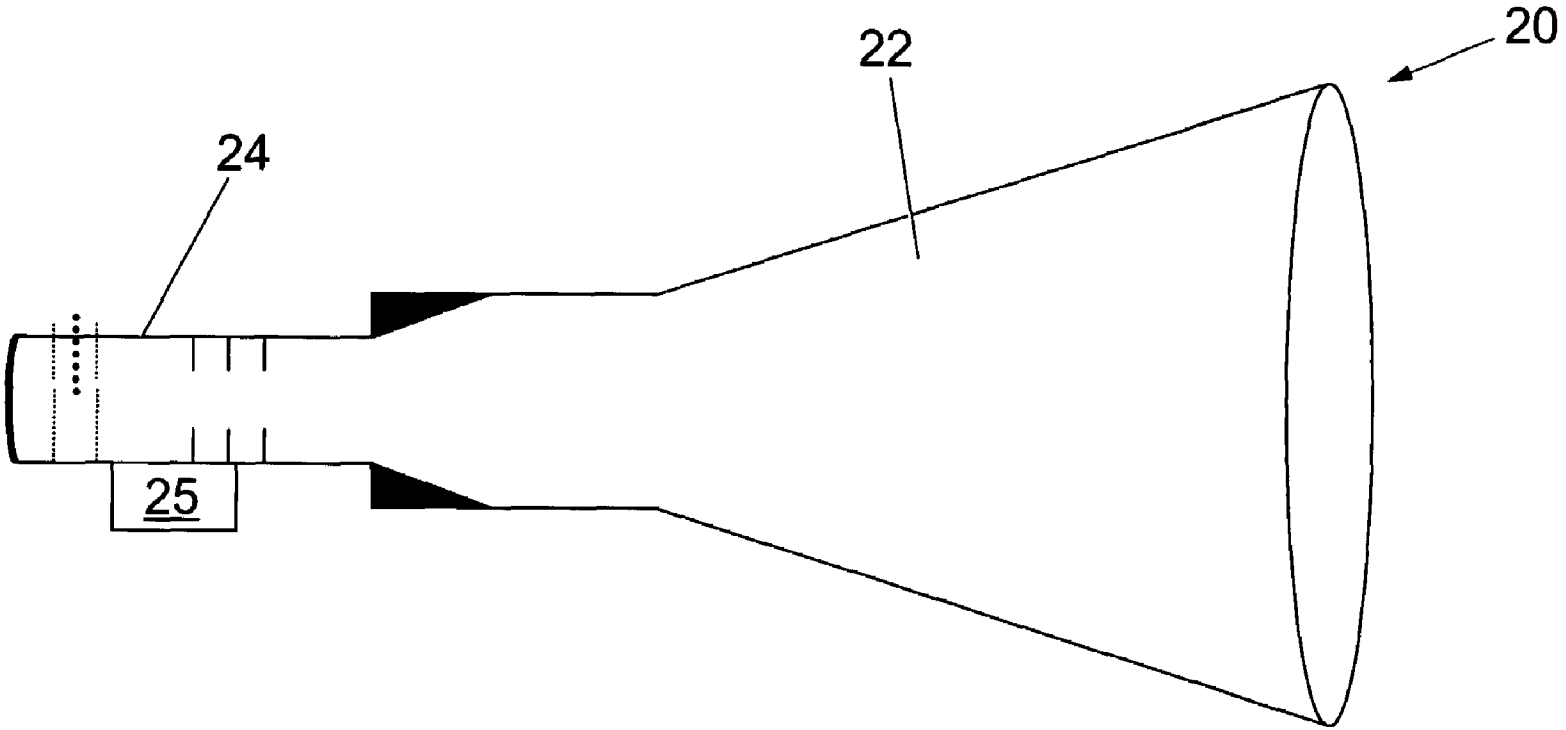
Figure 4A:
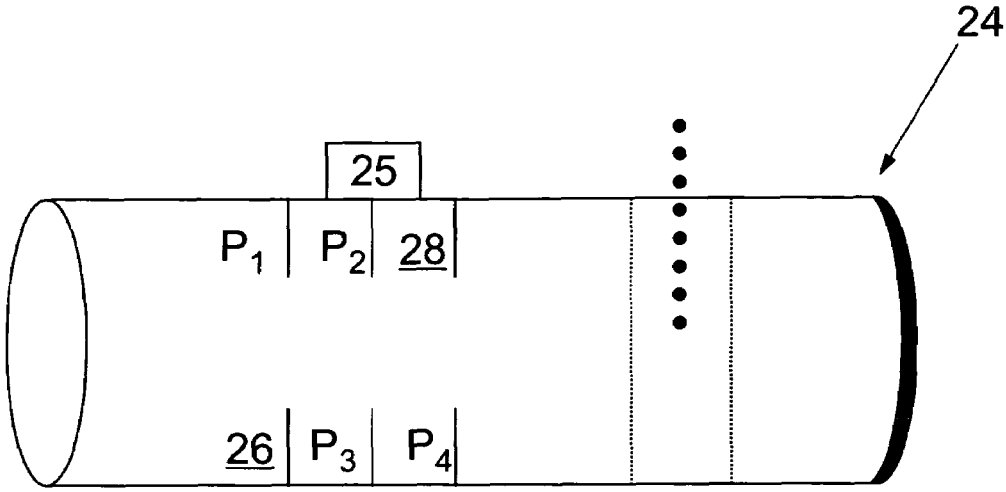
Figure 4B:
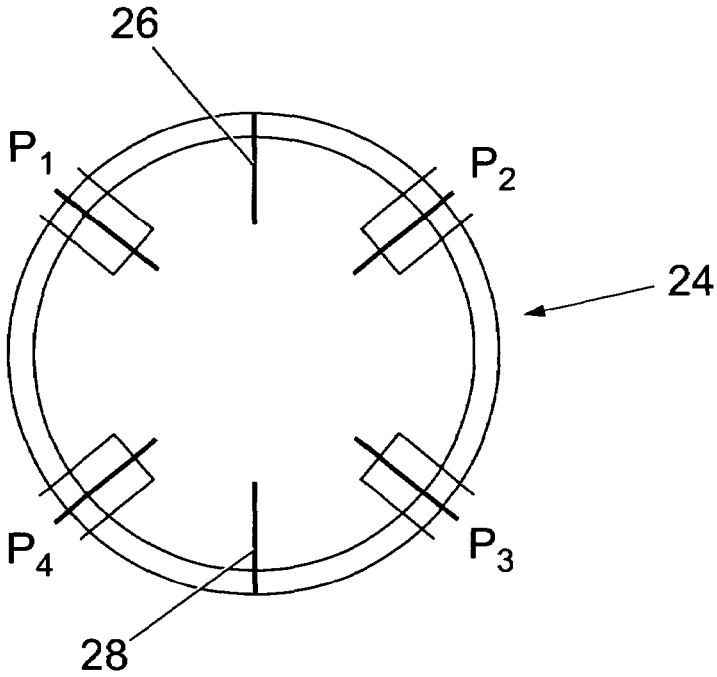

FIG. 3 is a cross-sectional view of a single aperture monopulse antenna in accordance with the invention;

FIG. 4*a* is a perspective view of a linear to circular polarizer employed in the single aperture monopulse antenna shown in FIG. 2;

FIG. 4*b* is a cross-sectional view of the linear to circular polarizer shown in FIG. 4*a;*

Figure 5B:
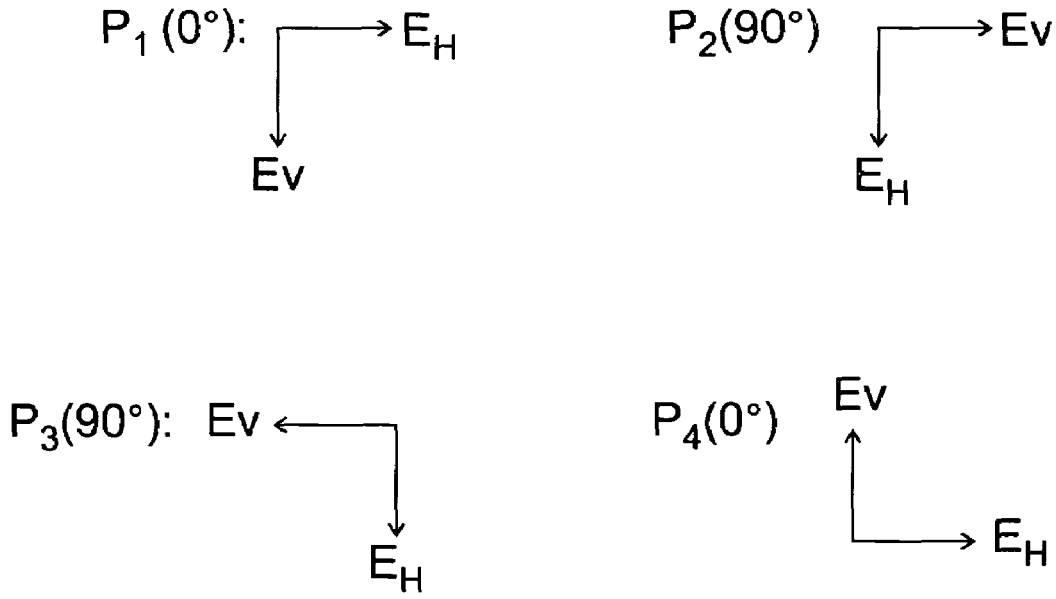
Figure 5C:
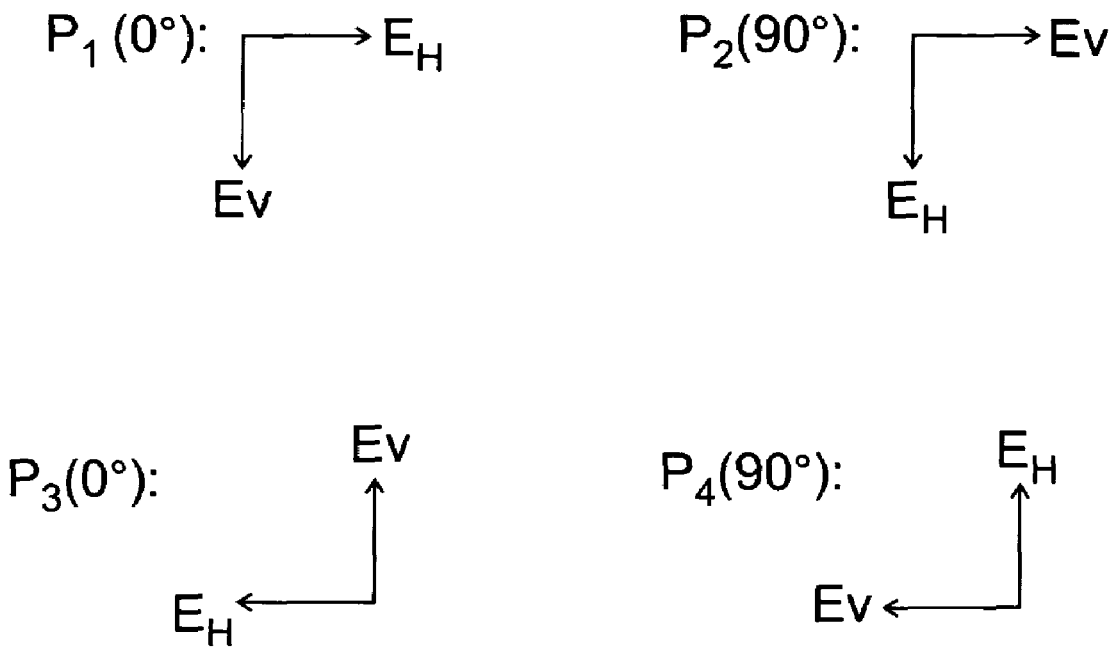
Figure 6:
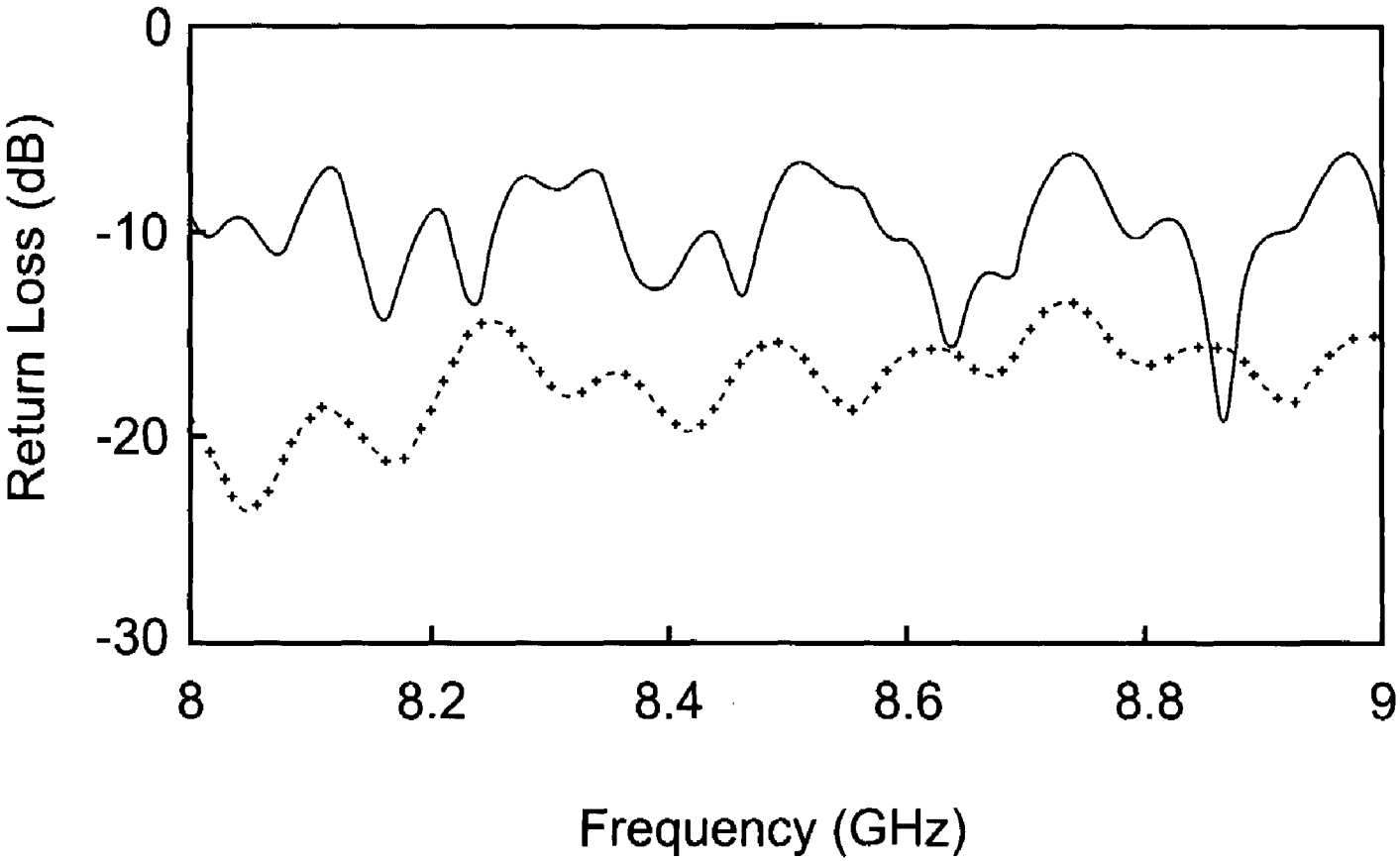
Figure 7:
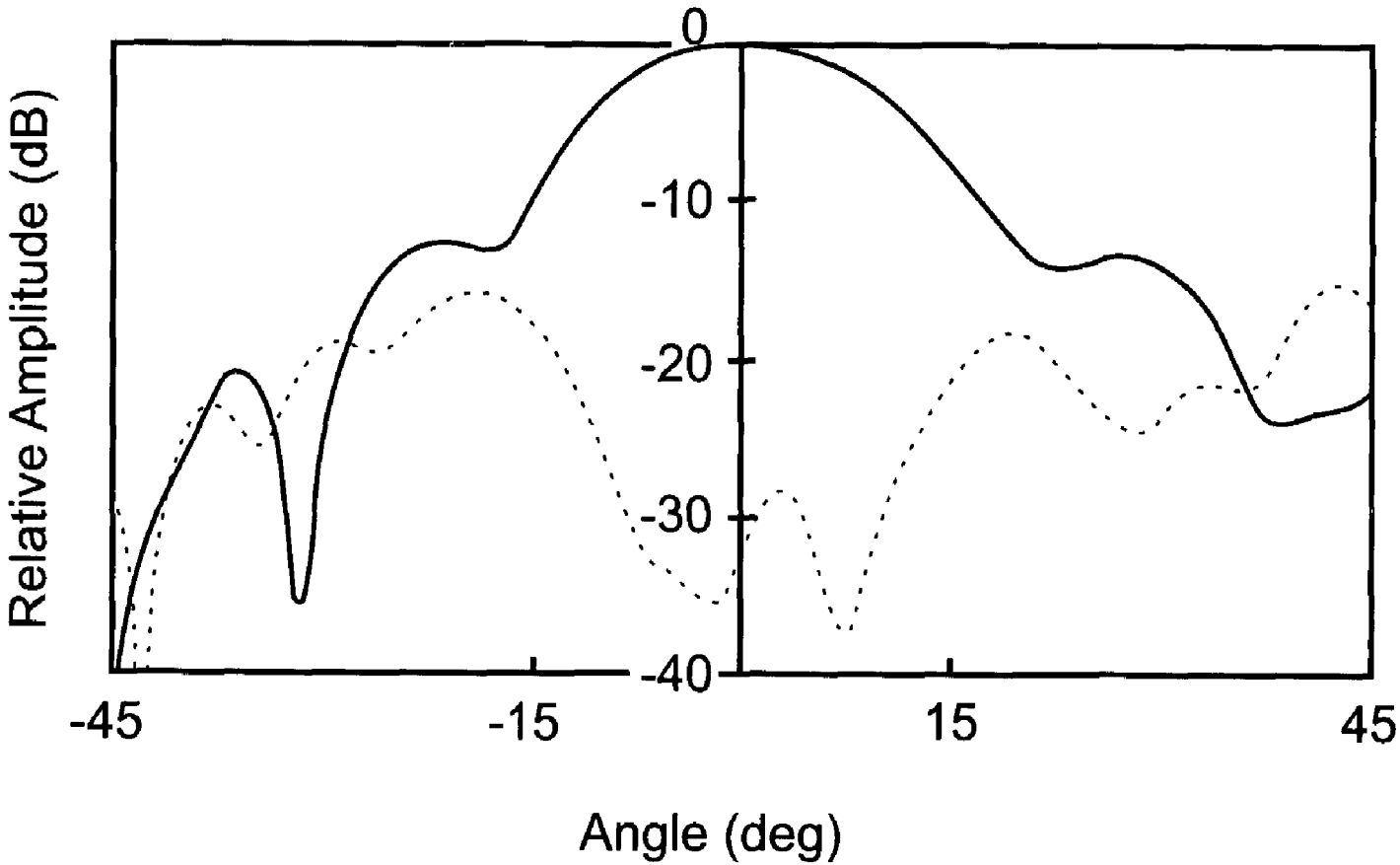
Figure 8:
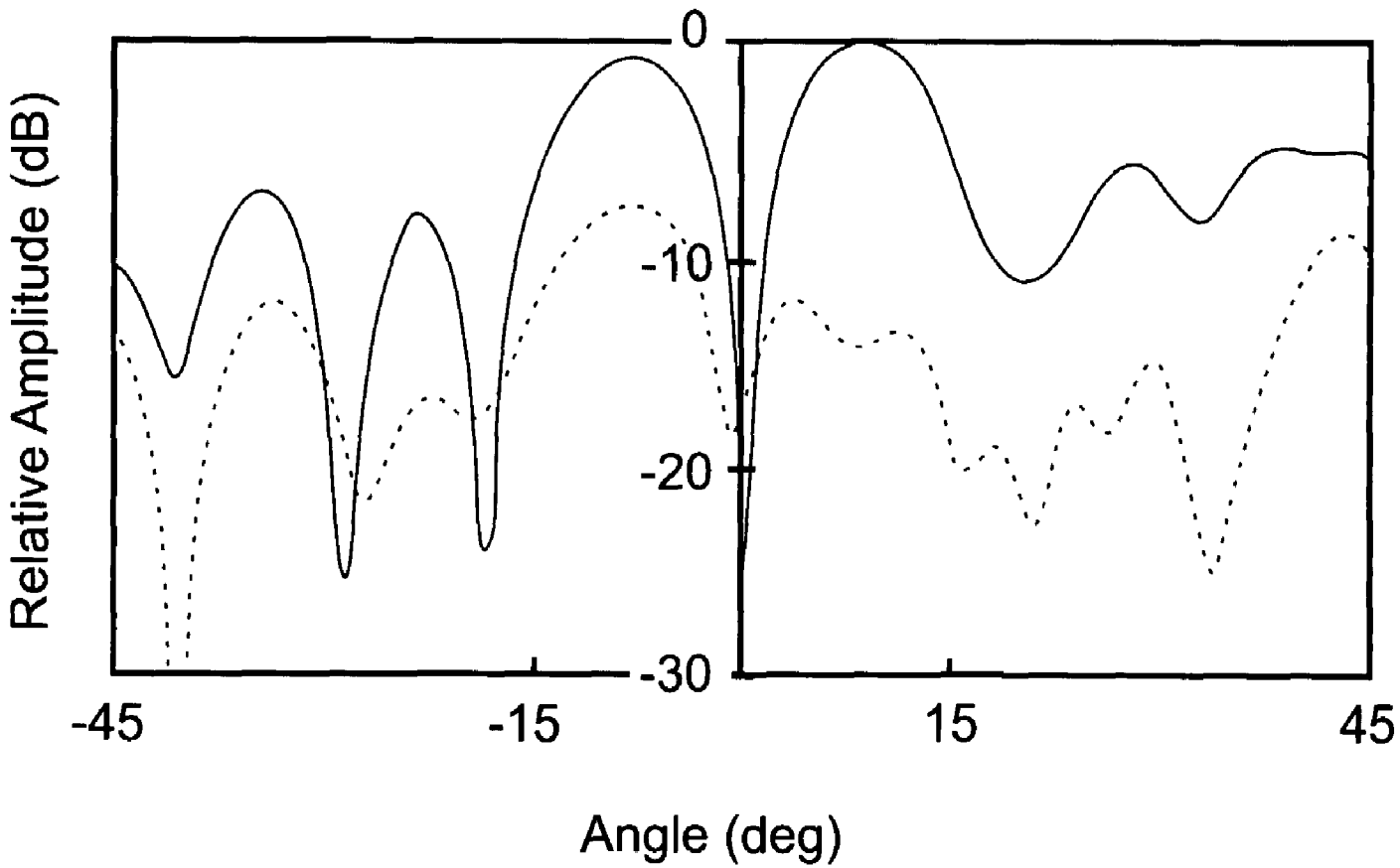

FIG. 5(*a*) shows the orientation of the electric field vectors generated when an LP wave is applied to the four probes of the linear to circular polarizer shown in FIG. 4(*a*);

FIG. 5(*b*) shows the orientation of the electric field vectors generated when an LP wave is applied to the four probes of the linear to circular polarizer shown in FIG. 4(*a*) and phase shifted to produce a summation field pattern;

FIG. 5(*c*) shows the orientation of the electric field vectors generated when an LP wave is applied to the four probes of the linear to circular polarizer shown in FIG. 4(*a*) and phase shifted to produce a difference field pattern;

FIG. 5(*d*).1 shows the orientation of the horizontal field components of an LP wave applied to the four probes of the linear to circular polarizer shown in FIG. 4(*a*) and phase shifted to produce a summation field pattern;

FIG. 5(*d*).2 shows the orientation of the vertical field components of an LP wave applied to the four probes of the linear to circular polarizer shown in FIG. 4(*a*) and phase shifted to produce a summation field pattern;

FIG. 5(*e*).1 shows the orientation of the horizontal field components of an LP wave applied to the four probes of the linear to circular polarizer shown in FIG. 4(*a*) and phase shifted to produce a difference field pattern;

FIG. 5(*e*).2 shows the orientation of the vertical field components of an LP wave applied to the four probes of the linear to circular polarizer shown in FIG. 4(*a*) and phase shifted to produce a difference field pattern;

FIG. 6 is a graph of the phasing network return loss obtained from the prototype single aperture monopulse antenna when all of the phasing network output ports are (i) connected to all four polarizer feed probes (denoted by solid line), and (ii) terminated with 50Ω to (denoted by dotted line);

FIG. 7 is a graph of the co-polar summation far field pattern (solid line) and cross-polar summation far field patter (dotted line) recorded from the prototype single aperture monopulse antenna at 8.6 GHz; and FIG. 8 is a graph of the co-polar difference far field pattern (solid line) and cross-polar difference far field patter (dotted line) recorded from the prototype single aperture monopulse antenna at 8.6 GHz.

The following description of the single aperture monopulse antenna will start with a general overview of the entire single aperture monopulse antenna apparatus followed by a more detailed discussion of the operation of the individual components of the apparatus.

1. Broad Overview of the Single Aperture Monopulse Antenna Apparatus

Referring to FIG. 3, a single aperture monopulse antenna 20 comprises a conical Potter horn 22 combined with an integral four port, probe fed, linear to circular polarizer 24 and a phasing network 25. When excited through the phasing network 25, the probes of the linear to circular polarizer 24 generate combinations of CP waves that combine in the far field of the single aperture monopulse antenna 20 to produce LP summation (Σ) and difference (Δ) field patterns similar to those employed in traditional monopulse radar tracking systems.

2. Individual Components of the Single Aperture Monopulse Antenna (a) Linear to Circular Polarizer 24

The linear to circular polarizer 24 is based on a modified version of the metal post-probe apparatus shown in FIGS. 2(*a*) to 2(*d*). In particular, the linear to circular polarizer 24 is a differential phase-shifter configured to act as a coaxially fed polarizer (A. Fox, *PIRE,* 35(12), 1947, p 1489-1498 and H. Schrank, IEEE Antennas and Propagation Society Newsletter, October 1984, pp. 12).

Referring to FIGS. 3*a* and 3*b*, the linear to circular polarizer 24 comprises four probes $P_1$, $P_2$, $P_3$ and $P_4$ arranged symmetrically around the circumference of the linear to circular polarizer 24 and extending into the interior of the linear to circular polarizer 24. The linear to circular polarizer 24 also comprises two metal posts 26 and 28 extending into the interior of the linear to circular polarizer 24 and disposed between opposing pairs of probes, so that post 26 is positioned and equispaced between probes $P_1$ and $P_2$ and post 28 is positioned and equispaced between probes $P_3$ and $P_4$.

For the sake of clarity in the following discussion, post 26 will henceforth be defined as the 0° position on the linear to circular polarizer 24. Accordingly, probes $P_1$, $P_2$, $P_3$ and $P_4$ are disposed at the −45°, 45°, 135° and 225° positions respectively on the linear to circular polarizer 24.

As discussed in relation to FIGS. 2(*a*) to 2(*d*), in operation, a voltage (i.e. an LP wave) is applied to probe $P_1$ (for a RHCP wave) or $P_2$ (for an LHCP wave). The nearest post (i.e. post 26 or 28) decomposes the incident LP wave into two orthogonal components and adds a 90° phase shift to the vertical component of the incident wave. When the vertical component and the horizontal component of the incident LP wave are recombined at the output from the linear to circular polarizer 24, an RHCP or LHCP wave is generated.

The phases of the LP waves applied to each probe are controlled by phasing network 25. The phasing network comprises a 3 dB Wilkinson Power divider and two 90° branch line couplers. This circuit design eliminates the need for a more complex phasing matrix circuit design.

As will be recalled, the monopulse radar tracking system employs broadside summation Σ and difference Δ far field patterns to detect and locate a target. In order to produce the summation and difference field patterns, the four probes $P_1$, $P_2$, $P_3$ and $P_4$ are fed with uniform amplitude LP waves. The phases of the LP waves applied to each probe are altered by the phasing network 25 in accordance with the phase relationships shown in Table 1 below.

TABLE 1

Phase Relationships of LP waves applied to each probe in the linear to circular polarizer 24 to produce summation and difference far field patterns.

| | Probe Phase Shifts | | | |
|---|---|---|---|---|
| Pattern | $P_1$ | $P_2$ | $P_3$ | $P_4$ |
| Σ | 0° | 90° | 90° | 0° |
| Δ | 0° | 90° | 0° | 90° |

Progressing from FIG. 5(*a*) to FIG. 5(*b*) and FIG. 5(*d*). 2 it can be seen that when the LP waves applied to the four probes ($P_1$, $P_2$, $P_3$ and $P_4$) in the linear to circular polarizer 24 are phase shifted in accordance with the Σ phase relationship shown in Table 1, the vectors corresponding to the decomposed vertical component ($E_v$) of the incident LP wave from the four probes ($P_1$, $P_2$, $P_3$ and $P_4$) cancel each other out.

Similarly, referring to FIG. 5(*d*).1 it can be seen the superposition of the decomposed horizontal components ($E_H$) of the incident LP wave from the four probes ($P_1$, $P_2$, $P_3$ and $P_4$) produces a linearly polarized field component ($E_x$) oriented at −45° relative to the vertical components from the $P_2$ and $P_3$ probes. The inclusion of an additional phase shift α, into the phasing unit 25 output ports would allow the tilt angle of the linearly polarized field component $E_x$ to be rotated as required. This could be useful in an operational monopulse radar system when optimization of the RCS target return polarization is required.

Similarly, progressing from FIG. 5(*a*) to FIG. 5(*c*) and FIG. 5(*e*).1 it can be seen that when the LP waves applied to the four probes ($P_1$, $P_2$, $P_3$ and $P_4$) in the linear to circular polarizer 24 are phase shifted in accordance with the Δ phase relationship shown in Table 1, the horizontal components ($E_H$) of the field vectors from the four probes mutually cancel.

Finally, referring to FIG. 5(*e*).2, it can be seen that the decomposed vertical components ($E_v$) of the incident LP wave from the four probes ($P_1$, $P_2$, $P_3$ and $P_4$) mutually cancel. Overall, this causes a zero field to be produced at the boresight (i.e. the null condition) in a similar fashion to the Δ field patterns used in conventional monopulse radar tracking applications.

(b) Potter Horn

A Potter horn 22 is used as the radiating element of the single aperture monopulse antenna. A Potter Horn 22 is a modified version of a standard conical horn antenna that operates by ensuring that a small component of the dominant $TE_{11}$ mode of the waveguide is converted to the $TM_{11}$ mode within the horn circular waveguide structure. These two modes are in anti-phase in the upper and lower boundary regions of the horn. Consequently, the two modes partially cancel each other when they combine in the aperture. This increases the edge taper in the E plane thereby broadening the pattern to give an axisymmetric far-field beam (in contrast with the elliptical far-field beam of a conventional conical horn).

A change in the waveguide dimensions near the horn throat provides the simplest means to generate a required additional mode component [P. D. Potter, Microwave J., 1963, 6, pp.71-78].

It should be understood that the single aperture monopulse antenna is not limited to the production of Σ and Δ far field patterns. Instead, the phase relationships employed in the CP wave superposition technique described above could be modified to mimic many far field patterns from a single aperture.

3. Prototype of Single Aperture Monopulse Antenna

A prototype metal post loaded polarizer was designed using 3D EM software (MICRO-STRIPES Version 6.0, Flomerics Limited, 81 Bridge Road, Hampton Court, Surrey, KT8 9HH, U.K.) and constructed for I-band operation. The polarizer has a diameter and length of 26 mm and 79 mm respectively. As described previously, the polarizer is provided with metal posts that have a diameter and depth of 3 mm and 5.3 mm respectively.

Four coaxial sub-miniature Amphenol (SMA) connectorised probes were inserted into the waveguide at a depth of 8.4 mm to launch an electric field and thereby excite the polarizer circular waveguide into its dominant mode. This depth was chosen to ensure that the input impedance to the SMA probe was 50Ω when a short circuit is placed 25 mm from the probe. The SMA probes 24 were also positioned at 20 mm from the nearest polarizer metal post.

It will be recognised that the above-mentioned dimensions serve only to describe an example of the single aperture monopulse antenna and should in no way be construed as limiting the dimensions of the single aperture monopulse antenna.

4. Results Obtained from Prototype of Single Aperture Monopulse Antenna (a) Phasing Network Return Loss of the Prototype Single Aperture Monopulse Antenna Referring to FIG. 6, when all of the phasing network output ports are connected to all four polarizer feed probes phasing network return loss was better than 8.5 dB over the operating range of the Potter Horn.

For reference purposes, each of the phasing network output ports were connected to a 50Ω resistor. In this case, the phasing network return loss is better than −15 dB over the operating frequency band.

(b) Synthesised Phase of Phasing Network of the Prototype Single Aperture Monopulse Antenna

TABLE 2

Comparison of the theoretical (Th) and measured (Ms) phases applied by the phasing network to the linear to circular polarizer in the prototype single aperture monopulse antenna

| | Probe Phases (Theory [Th] & Measured [Ms]) | | | | | | | |
|---|---|---|---|---|---|---|---|---|
| | $P_1$ | | $P_2$ | | $P_3$ | | $P_4$ | |
| PTN | Th | Ms | Th | Ms | Th | Ms | Th | Ms |
| Σ | 0° | 4.6° | 90° | 102° | 90° | 107° | 0° | 11° |
| Δ | 0° | 4.6° | 90° | 102° | 0° | 11° | 90° | 107° |

Table 2 compares the theoretical phase applied by the phasing network to each probe in the polarizer (denoted by Th) with the actual measured phase response (Ms) of the feed network at 8.6 GHz. 8.6 GHz was selected as the signal frequency since it provided the best amplitude balance, <0.06 dB worst case relative magnitude difference between the ports, as well as best match to the theoretical feed port phase requirement. However, it will be appreciated that the single aperture monopulse antenna is not limited to operation at 8.6 GHz and is instead potentially operable over a wide selection of frequencies.

(c) Measurements of the Linearly Polarized Far Field Patterns Obtained from the Prototype Single Aperture Monopulse Antenna FIGS. 7 and 8 respectively show the results from measurements of the linearly polarized far field summation and difference patterns radiated from the prototype single aperture monopulse antenna at a frequency of 8.6 GHz.

The principal plane for the co-polar far field radiation cuts was selected to yield a maximum radiated field strength and is as expected to be coincident with the 45° tilt angle.

Table 3 lists the principal far field pattern metrics (full patterns omitted for brevity), calculated for the prototype single aperture monopulse antenna for 8.4 GHz and 8.5 GHz waves.

TABLE 3

| Principal far field metrics calculated for the prototype single aperture monopulse antenna | | | |
|---|---|---|---|
| Frequency (GHz) | 3 dB BW (Deg.) | Gain (dBi) | Cross polarization at boresight (dB) |
| 8.4 | 19.8 | 18.4 | −22 |
| 8.5 | 19.5 | 18.6 | −29 |
| 8.6 | 19.2 | 18.7 | −31 |

For the summation far field pattern the gain was 18.6 dBi, and cross polar far field levels were below −29 dB, whilst for the difference far field pattern the depth of the null was 26 dB at 8.6 GHz.

Improvements and modifications can be made to the above without departing from the scope of the invention as defined in the claims.

The invention claimed is:

1. A single aperture monopulse antenna comprising a metal post polarizer having at least two probes and at least two posts, a phasing network connected to the probes, a conical horn integrally combined with the polarizer and forming a single antenna aperture, wherein voltage is applied to the probes through the phasing network, the probes generate a plurality of linearly polarized waves, the posts decompose the linearly polarized waves into orthogonal linearly polarized wave components and add a phase shift to at least one of the components, the linearly polarized wave components combine in the conical horn to generate a plurality of phase shifted circularly polarized waves, that superimpose to produce multiple field patterns from the single antenna aperture.

2. An antenna according to claim 1, in which the metal post polarizer comprises a number of probes which is substantially the same as the number of antenna apertures mimicked by the single aperture monopulse antenna.

3. An antenna according to claim 1, in which the phasing network is arranged to provide an additional phase shift ($\alpha$) operable to vary the tilt angle of the linear polarized field component.

4. An antenna according to claim 1, in which the circularly polarized waves are superimposed in the aperture of the single aperture monopulse antenna.

5. An antenna according to claim 1, in which the phasing network comprises a 3 dB Wilkinson power divider and at least two 90° branch line couplers.

6. An antenna according to claim 1, in which the single aperture horn antenna further comprises an axisymmetrical field radiating element.

7. An antenna according to claim 6, in which the axisymmetrical field radiating element is a Potter horn.

8. An antenna according to claim 1, in which the multiple field patterns are summation and difference patterns.

9. A radar tracking apparatus comprising a single aperture monopulse antenna according to claim 1 that superimposes phase shifted circularly polarized waves to produce multiple aperture antenna field patterns.

10. A mobile satellite communications system comprising a single aperture horn antenna according to claim 1 which superimposes phase shifted circularly polarized waves to produce multiple aperture antenna field patterns.

11. A vehicular anti-collision radar system comprising a single aperture horn antenna according to claim 1 which superimposes phase shifted circularly polarized waves to produce multiple aperture antenna field patterns.

12. An antenna according to claim 1, in which the metal post polarizer has a plurality of probes, and voltage is applied to the plurality of probes through the phasing network, and the plurality of probes generate a plurality of phase shifted linearly polarized waves, the phases of which are controlled by the phasing network.

13. An antenna according to claim 12, in which the plurality of probes comprises four probes.

14. A method of generating multiple field patterns from a single aperture antenna comprising a metal post polarizer having at least two probes and at least two posts, a phasing network connected to the probes, a conical horn integrally combined with the polarizer and forming a single antenna aperture, wherein voltage is applied to the probes through the phasing network, the probes generate a plurality of linearly polarized waves, the posts decompose the linearly polarized waves into orthogonal linearly polarized wave components and add a phase shift to at least one of the components, the linearly polarized wave components combine in the circular horn to generate a plurality of phase shifted circularly polarized waves, and the patterns are generated by the superposition of the plurality of phase shifted circularly polarized waves to create superimposed linearly polarized waves.

15. The method of claim 14, in which the superimposed linearly polarized waves produce summation and difference field patterns.

16. The method of claim 15, in which the summation field pattern is produced by the superposition of at least one right circularly polarized wave with an equal number of left circularly polarized waves.

17. The method of claim 15, in which the difference field pattern is produced by the superposition of at least one right circularly polarized wave with at least one left circularly polarized wave wherein the at least one left circularly polarized wave is provided with an appropriate phase shift.

* * * * *